US008522589B2

(12) United States Patent
Travini et al.

(10) Patent No.: US 8,522,589 B2
(45) Date of Patent: Sep. 3, 2013

(54) MACHINE OF VARIABLE LINEAR STRUCTURE FOR THE FORMATION OF TUBES

(75) Inventors: Vittorio Travini, Borgo San Siro (IT); Riccardo Bosoni, Agazzano (IT)

(73) Assignee: Olimpia 80 S.r.l., Borgo San Siro (Pavia) (IT)

( * ) Notice: Subject to any disclaimer, the term of this patent is extended or adjusted under 35 U.S.C. 154(b) by 130 days.

(21) Appl. No.: 12/979,742

(22) Filed: Dec. 28, 2010

(65) Prior Publication Data

US 2012/0160006 A1 Jun. 28, 2012

(51) Int. Cl.
*B21B 39/02* (2006.01)
*B21D 5/14* (2006.01)
*B21D 39/02* (2006.01)

(52) U.S. Cl.
USPC ..... 72/133; 72/51; 72/179

(58) Field of Classification Search
USPC ..... 72/51, 52, 133, 178, 179, 135, 181, 72/182, 252.5; 228/17.5
See application file for complete search history.

(56) References Cited

U.S. PATENT DOCUMENTS 7,721,579 B2 * 5/2010 Bartlett et al. ..... 72/178

FOREIGN PATENT DOCUMENTS

| | | | |
|---|---|---|---|
| DE | 2529466 | A1 | 2/1976 |
| EP | 0988905 | A2 | 3/2000 |
| EP | 1393830 | A1 | 3/2004 |

OTHER PUBLICATIONS

European Search Report, dated Nov. 4, 2009, from corresponding European application.

* cited by examiner

*Primary Examiner* — Teresa M Ekiert
(74) *Attorney, Agent, or Firm* — Young & Thompson

(57) ABSTRACT

The machine for the formation of tubes includes at least, in series with each other, forming stations including pairs of idle rollers which make rototranslational movements of the same amplitude but in opposite directions, and at least one finishing station including four idle rollers having a concave profile with a constant curvature and able to perform rototranslational movements of the same amplitude and direction according to 90° axes. The lower rollers of each forming station have an elliptical profile with a curvature decreasing form the outer edge to the inner edge of the roller. The upper rollers of the first forming station have an elliptical profile with a curvature increasing from the outer edge to the inner edge of the roller; the upper rollers of the forming stations subsequent to the first have a circular profile.

11 Claims, 10 Drawing Sheets

MACHINE OF VARIABLE LINEAR STRUCTURE FOR THE FORMATION OF TUBES

BACKGROUND OF THE INVENTION

1. Field of the Invention

The present invention refers to a machine for the formation of tubes, called "of variable linear structure", which comprises a plurality of forming stations, placed in series with each other, which progressively bend a strip of sheet metal to form a tube, followed by at least one finishing station which further brings together the edges of the bent strip of sheet metal in view of the final welding.

2. Description of the Related Art

Machines for forming tubes by means of continuous bending of sheet metal are well known to the art and comprise, in series with each other, a plurality of stations in which the strip of sheet metal is progressively deformed by pairs of rollers having matching profiles.

These machines of the prior art have the drawback of making it necessary to replace the pair of rollers when it is desired (or necessary) to change the diameter of the tube produced, which leads to more or less long machine downtimes which reduce the productivity of the plant.

BRIEF SUMMARY OF THE INVENTION

To overcome this serious drawback, machines for forming tubes by means of continuous bending of sheet metal have been proposed (such as, for example, that described in European patent EP 1 393 830 in the name of the Applicant) in which the two pairs of rollers with matching profiles belonging to a station can make rototranslational movements of the same amplitude but in opposite directions, making it possible to use the same pairs of rollers to produce tubes whose diameter falls within a more or less broad range of values.

Object of the present invention is to realise a machine "of variable linear structure" for the formation of tubes, which improves the performance of machines of the type described, for example, by the aforementioned European patent since it allows the range of values of the diameter of the tubes to be widened without having to replace the pairs of rollers.

This object is achieved by means of a machine which has the characterising features indicated in independent claim 1.

Further advantageous characteristics of the invention form the subject matter of the dependent claims.

A machine for continuous formation of tubes realised according to the invention comprises, in series with each other, forming stations which progressively bend a strip of sheet metal and at least one finishing station which further brings together the edges of the bent strip of sheet metal in view of the final welding.

Each forming station comprises two pairs of idle forming rollers which make rototranslational movements of the same amplitude but in opposite directions and the at least one finishing station comprises four idle forming rollers able to make movements of the same amplitude and direction according to 90° axes.

The profile of the lower rollers of each forming station is elliptical with a decreasing curvature from the outer edge to the inner edge of said roller, that of the upper rollers of the first forming station is elliptical with an increasing curvature from the outer edge to the inner edge of said roller, that of the upper rollers of the forming stations subsequent to the first one (hereafter called "second forming stations") is circular and that of the forming rollers of the at least one finishing station is concave with a constant curvature.

The radius of the circular profile of the upper rollers of each second forming station preferably corresponds to the minimum radius of curvature of the bent strip of sheet metal in correspondence of said second forming station and the curvature of the concave profile of the forming rollers of the at least one finishing station corresponds to the maximum curvature of the bent strip of sheet metal in correspondence of said finishing station.

A machine according to the invention is called "of variable linear structure" since (as indicated very diagrammatically in FIGS. 5 and 7) makes it possible to produce tubes of different diameters by changing the reciprocal positions of the two pairs of rollers and those of each of the rollers of each pair.

BRIEF DESCRIPTION OF THE DRAWINGS

The invention will now be described with reference to purely exemplifying (and therefore non limiting) embodiments thereof illustrated in the appended figures, wherein.

DETAILED DESCRIPTION OF THE PREFERRED EMBODIMENTS

Figure 1:
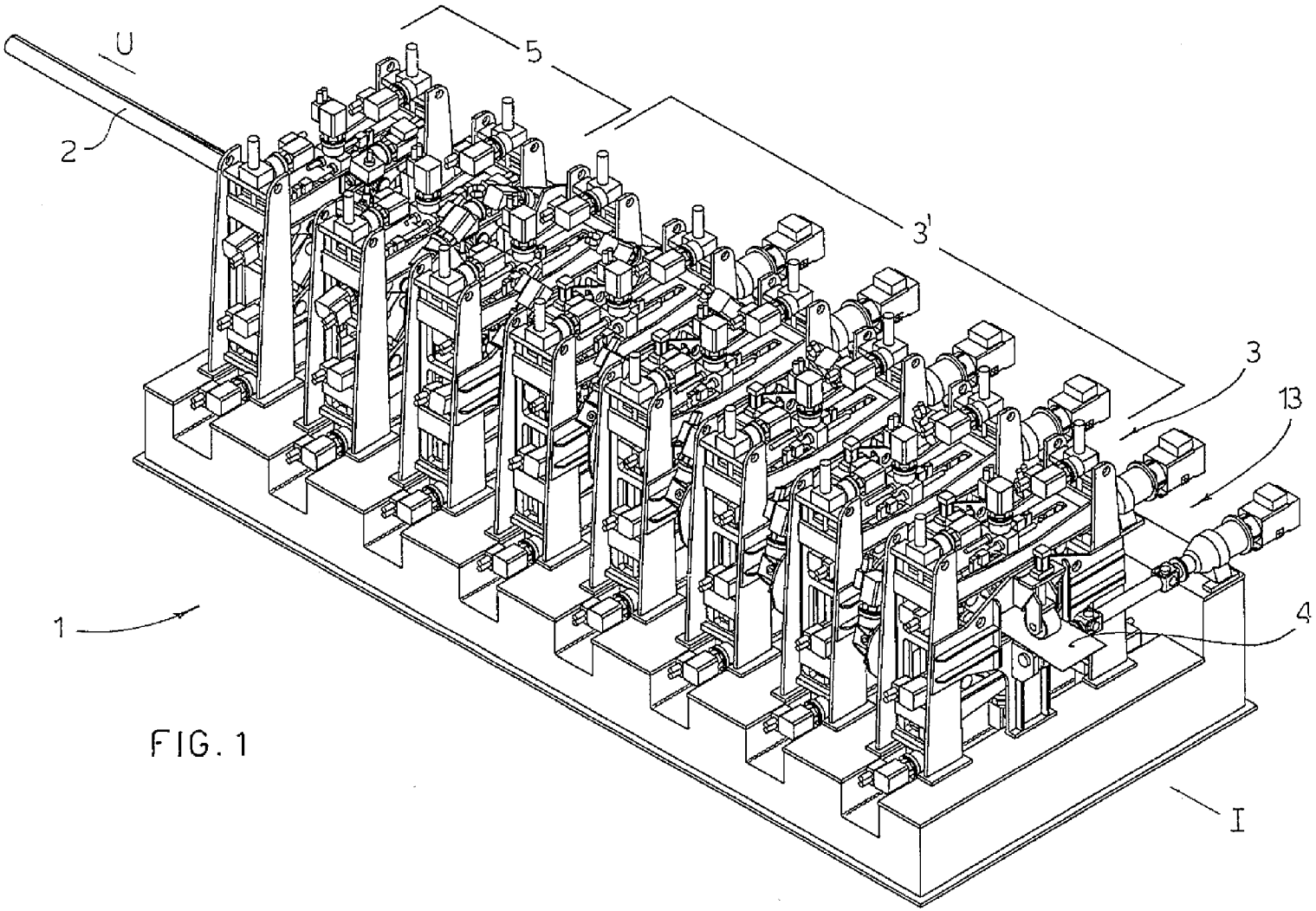
FIG. 1 shows diagrammatically a perspective view of a machine for the formation of tubes realised according to the invention.

In the appended figures corresponding elements will be identified by means of the same reference numerals.

FIG. 1 shows diagrammatically a perspective view of a machine 1 according to the invention for the formation of tubes 2 which comprises, in series with each other, traction means 13 for the strip of sheet metal 4 (which enters the machine 1 in the direction of the arrow I), a first forming station 3, second forming stations 3', containment stations 12 (each of which is situated downstream of a forming station), at least one finishing station 5 and at least one welding station (per se known and omitted in FIGS. 1 and 2), from which the tube 2 exits in the direction of the arrow U.

Figure 2:
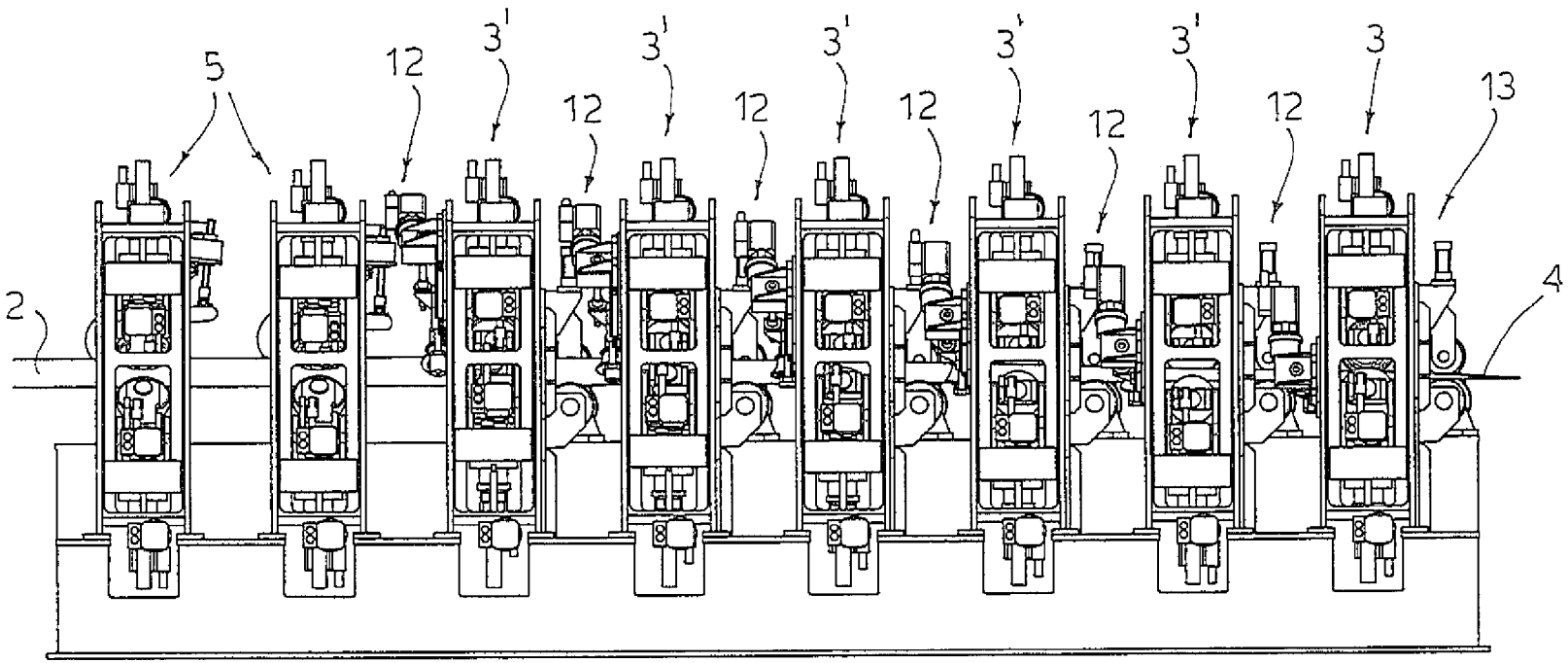
FIG. 2 shows diagrammatically a side view of the machine of FIG. 1.

In the embodiment illustrated in FIGS. 1 and 2 the machine 1 comprises five second forming stations 3', six containment stations 12 (visible in the side view of FIG. 2) situated downstream of the forming stations (3 3') and two finishing stations 5 but, without departing from the scope of the invention, the number of second forming stations 3' (and, consequently, that of containment stations 12) and finishing stations 5 can vary to meet the particular requirements of a specific machine 1.

The traction means 13 will not be described because they are per se known. The first forming station 3 will be described with reference to FIGS. 3-5, a second forming station 3' will be described with reference to FIGS. 6-7, a containment station 12 will be described with reference to FIG. 8 and a finishing station 5 will be described with reference to FIG. 9.

FIG. 2 shows diagrammatically a side view of the machine 1 of FIG. 1, which makes it possible to see more clearly the containment stations 12 situated downstream of a forming station (3, 3').

Figure 3A:
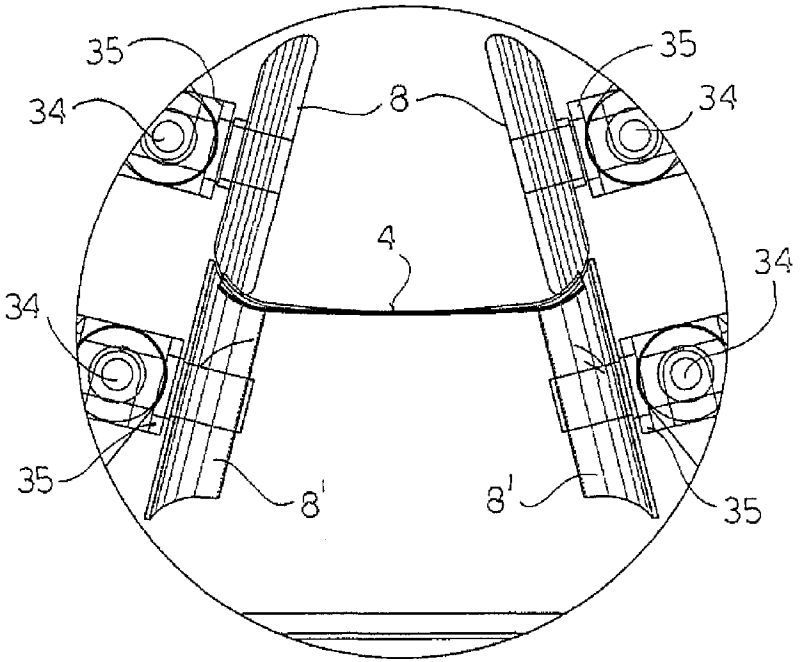
FIG. 3 shows diagrammatically a front view and an enlarged detail (FIG. 3*a*) of the first forming station of the machine of FIG. 1.
Figure 3:
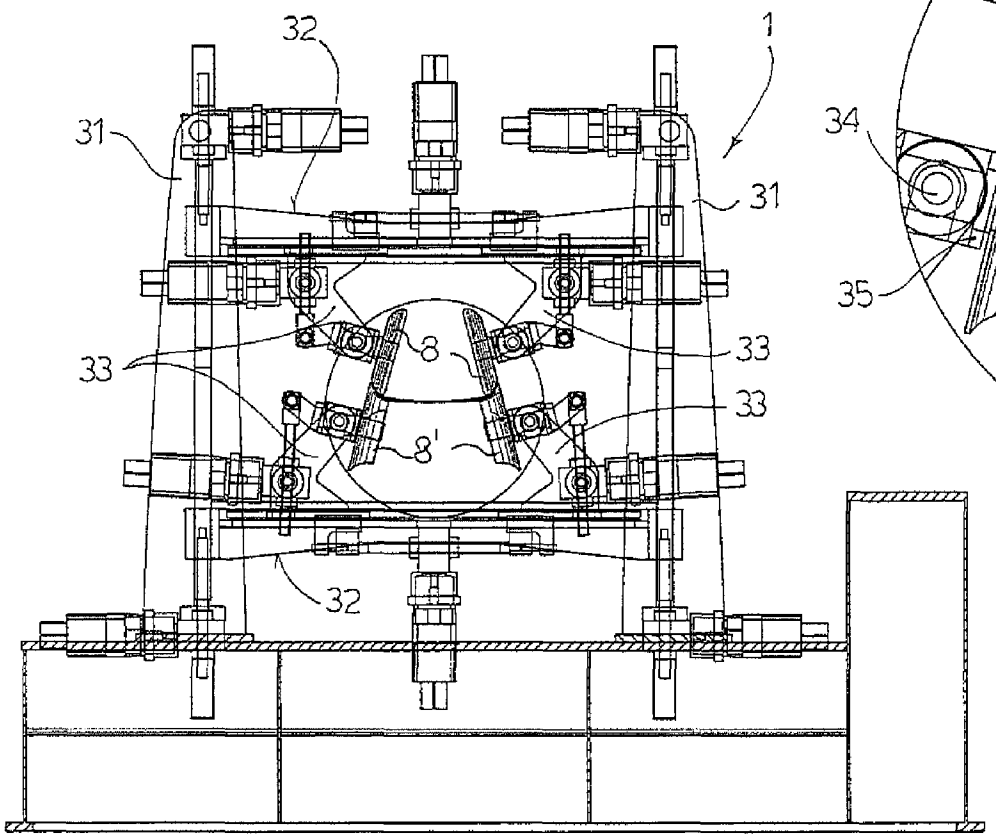

FIG. 3 shows diagrammatically a front view of the first forming station 3 of the machine 1, symmetrical with respect to the midline, which comprises two vertical uprights 31 which support two horizontal traverses 32, sliding along the uprights 31; along each traverse 32 slide two shoes 33, on each of which is present a pivot 34 which acts as a fulcrum for rotation of a unit 35 that carries one of the forming rollers (8, 8').

The pivots 34 and the units 35, which can be seen better in FIG. 3A, have not been designated with the corresponding reference numerals in FIG. 3 for the sake of clarity of the graphic representation.

Figure 5:
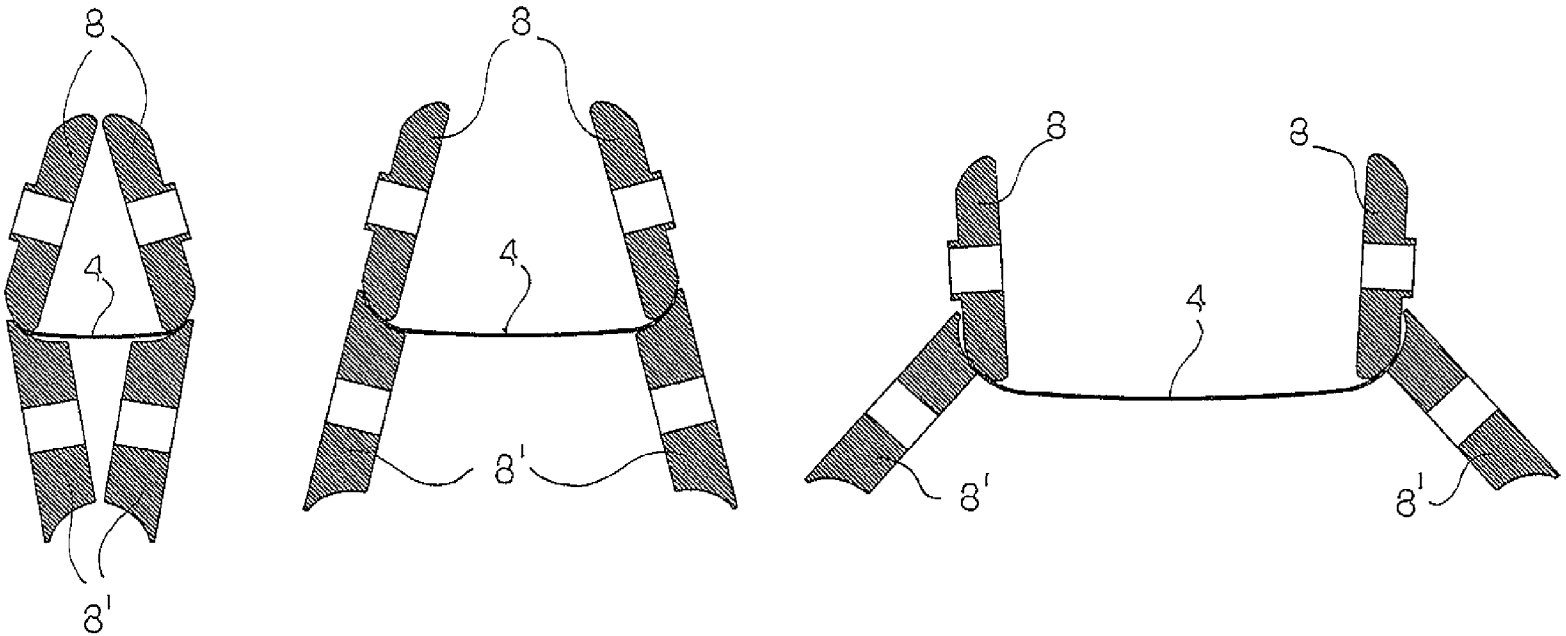
FIG. 5 shows diagrammatically, enlarged, the position assumed by the two pairs of forming rollers of the first forming station of FIG. 3 to produce three tubes of different diameters.

This supporting structure (32, 33, 34) allows the axes of the forming rollers (8, 8') to perform a rototranslational movement, in the vertical plane, inside the forming station 3 that allows a considerable freedom in positioning and orienting the rollers (8, 8') of each pair, whilst always keeping them in contact with each other, to adapt them to the diameter of the tube to be produced, as schematically indicated in FIG. 5, which shows the position assumed by the two pairs in rollers (8, 8') for three diameters of the tube 2 coming within the tubes 2 that can be produced without replacing the forming rollers (8, 8').

The sliding movements of the horizontal traverses 32 along the uprights 31 and of the shoes 33 along the traverses 32 and the rotation of the units 35 around the relative pivots 34 are of the same amplitude and opposite direction, take place along guides indicated schematically with dashed lines in FIG. 3 and are realised by means of activating means not described herein because they are per se known and not explicitly indicated in FIG. 3 for the sake of simplicity of the graphic representation.

FIG. 3A shows diagrammatically, enlarged, the area of the first forming station 3 comprising the two pairs of rollers (8, 8'), supported by the units 35, which deform the outermost area of the strip of sheet metal 4.

Figure 4:
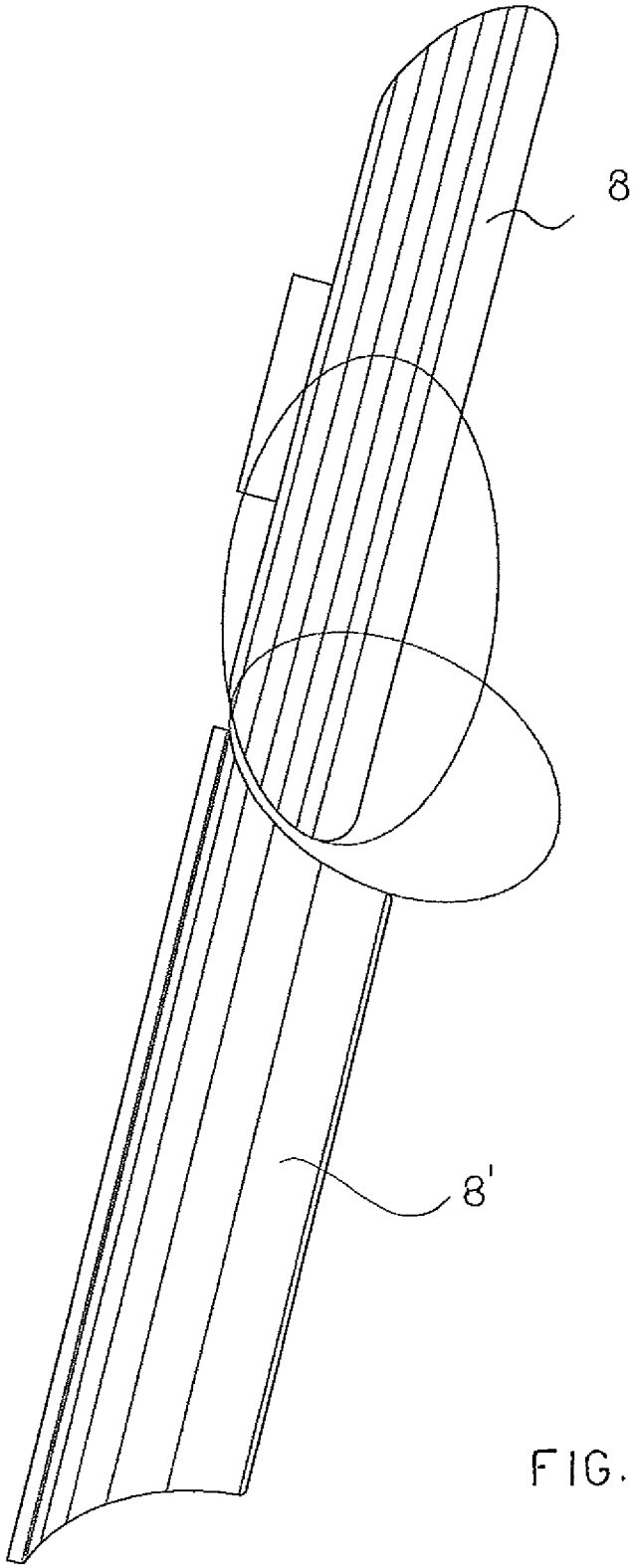
FIG. 4 shows diagrammatically, enlarged, a pair of forming rollers belonging to the first forming station of FIG. 3.

FIG. 4 shows diagrammatically, enlarged, a pair of forming rollers (8, 8'), realised according to the invention, belonging to the first forming station 3; from FIG. 4 it can be seen that the profile of the lower rollers 8' is elliptical with a curvature decreasing from the outer edge to the inner edge of the roller 8', whereas the profile of the upper rollers 8 is elliptical with a curvature increasing from the outer edge to the inner edge of the roller 8.

The ellipses to which the profiles of the rollers 8 and 8' belong have been indicated with dashed lines in FIG. 4.

FIG. 5 shows diagrammatically, enlarged, the position assumed by the two pairs of forming rollers (8, 8') of the first forming station 3 to produce three tubes 2 of different diameter coming within the tubes 2 that can be produced without replacing the forming rollers (8, 8'): the elliptical profiles of the rollers 8 and 8' allow the radius of curvature of the outermost areas of the strip of sheet metal 4 to be modified by modifying only the position and orientation of the rollers (8, 8').

Figure 6A:
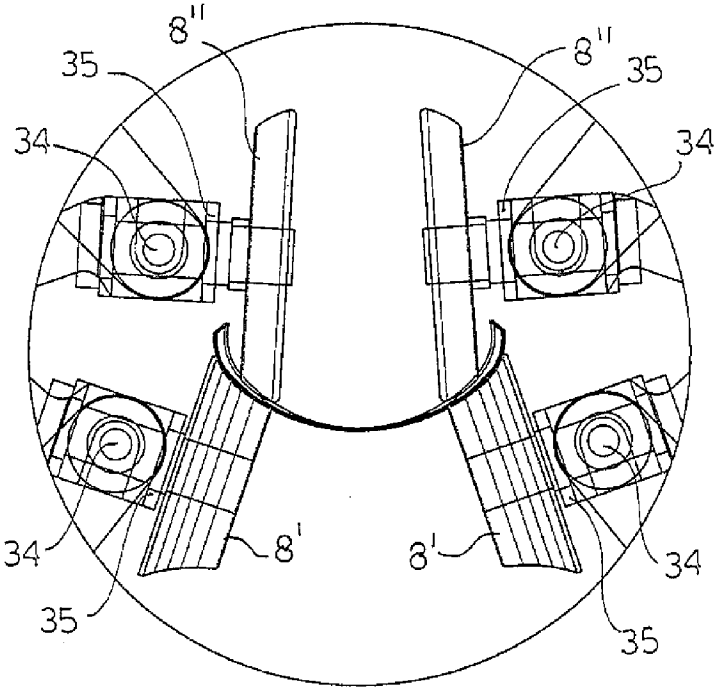
FIG. 6 shows diagrammatically a front view and an enlarged detail (FIG. 6*a*) of a second forming station of the machine of FIG. 1.
Figure 6:
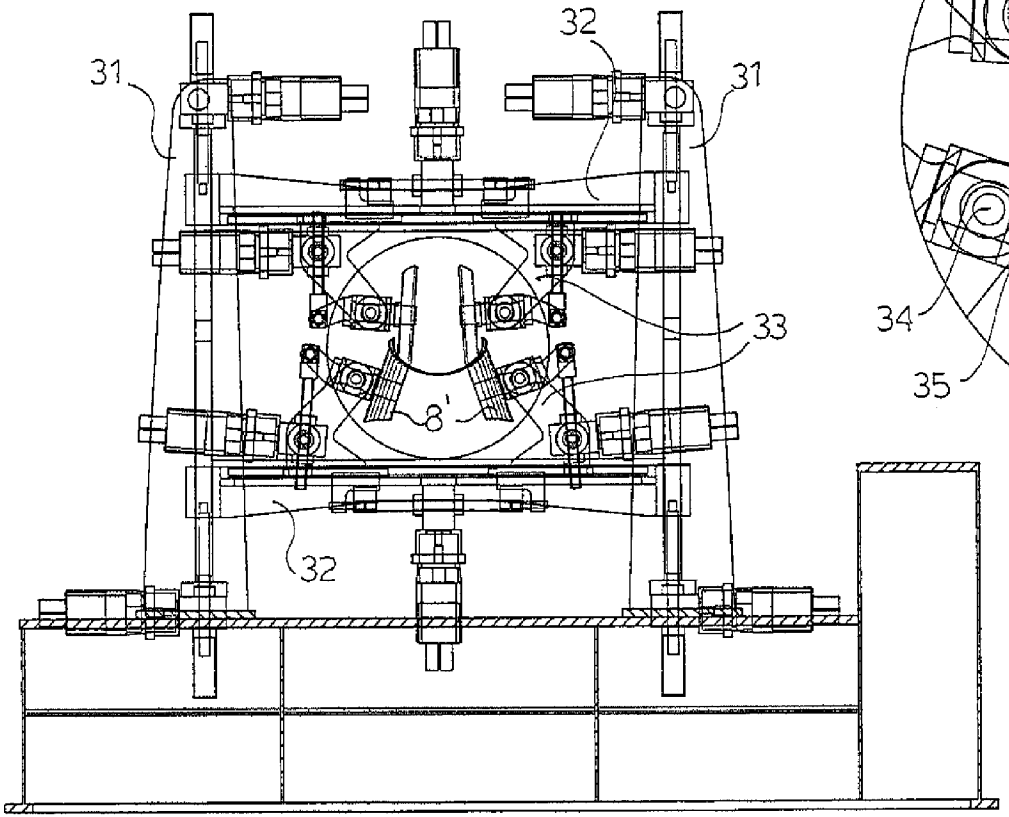

FIG. 6 shows diagrammatically a front view of one of the second forming stations 3' of the machine 1, situated downstream of the first forming station 3, from which it differs essentially in that the upper rollers 8" have a circular profile whose radius corresponds to the minimum radius of curvature (within the range of tubes 2 that can be produced without replacing the forming rollers 8' and 8") of the bent strip of sheet metal 4 in correspondence of said second forming station 3' and in that the pairs of forming rollers (8', 8") belonging to the second forming stations 3' deform the inner part of the strip of the sheet metal 4.

The pivots 34 and the units 35, seen better in FIG. 6*a*, have not been designated in FIG. 6 with the corresponding reference numerals for the sake of clarity of the graphic representation.

FIG. 6*a* shows diagrammatically, enlarged, a pair of forming rollers (8", 8'), realised according to the invention, belonging to a second forming station 3; from FIG. 6*a* it can be seen that the profile of the lower rollers 8' is elliptical with a curvature decreasing from the outer edge to the inner edge of the roller 8', whereas the profile of the upper rollers 8" is circular.

Figure 7:
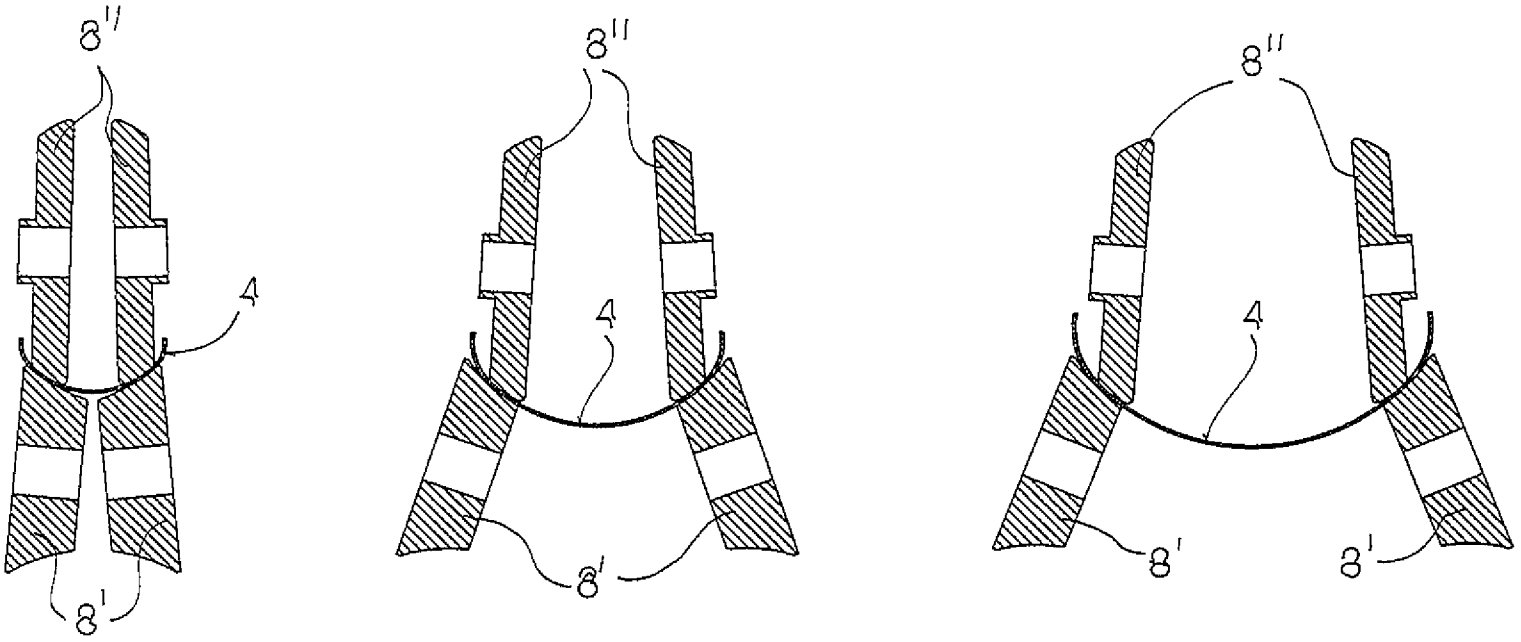
FIG. 7 shows diagrammatically, enlarged, the position assumed by the two pairs of forming rollers of the second forming station of FIG. 6 to produce the three tubes of different diameters of FIG. 5.

FIG. 7 shows diagrammatically, enlarged, the position assumed by the two pairs of forming rollers (8', 8") of the second forming station 3' of FIG. 6 to produce the three tubes of different diameter of FIG. 5: the elliptical profile of the lower rollers 8' allows the radius of curvature of the inner part of the strip of sheet metal 4 to be modified by modifying only the position and orientation of the forming rollers 8' and 8".

The amplitude of the rototranslational movements permitted to the forming rollers (8, 8', 8") by the supporting structure (32, 33, 34) and the particular profiles of the forming rollers (8, 8', 8") allow the range of values of the diameter of the tubes which can be produced without having to replace the forming (8, 8', 8") to be increased with respect to machines of the prior art.

Moreover, from the foregoing description it is obvious that, in the machine of the present invention, the strip of sheet metal 4 is not deformed by pairs of forming rollers (8, 8', 8") having matching profiles: this represents an obvious feature able to differentiate the machine of the present invention from machines of the prior art including that described in European patent EP 1 393 830.

Figure 8A:
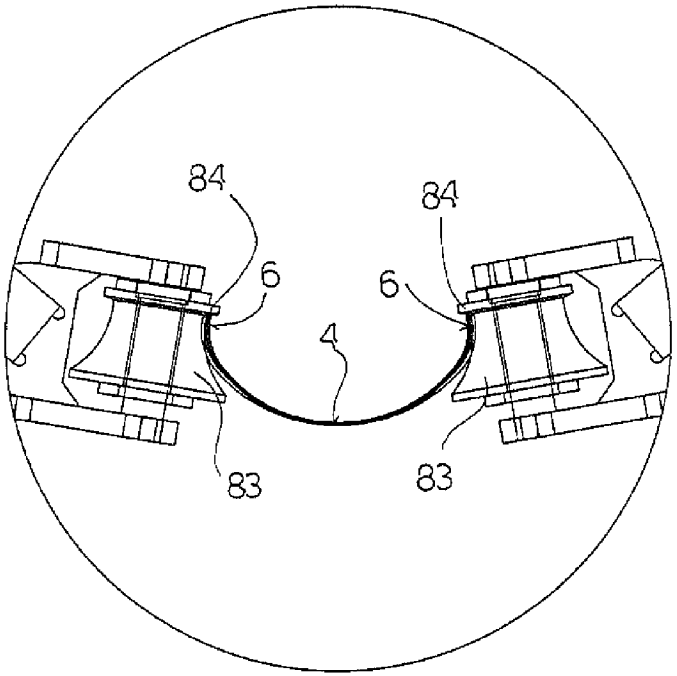
FIG. 8 shows diagrammatically a front view and an enlarged detail (FIG. 8*a*) of one of the containment stations situated downstream of the first forming station and of each of the second forming stations.
Figure 8:
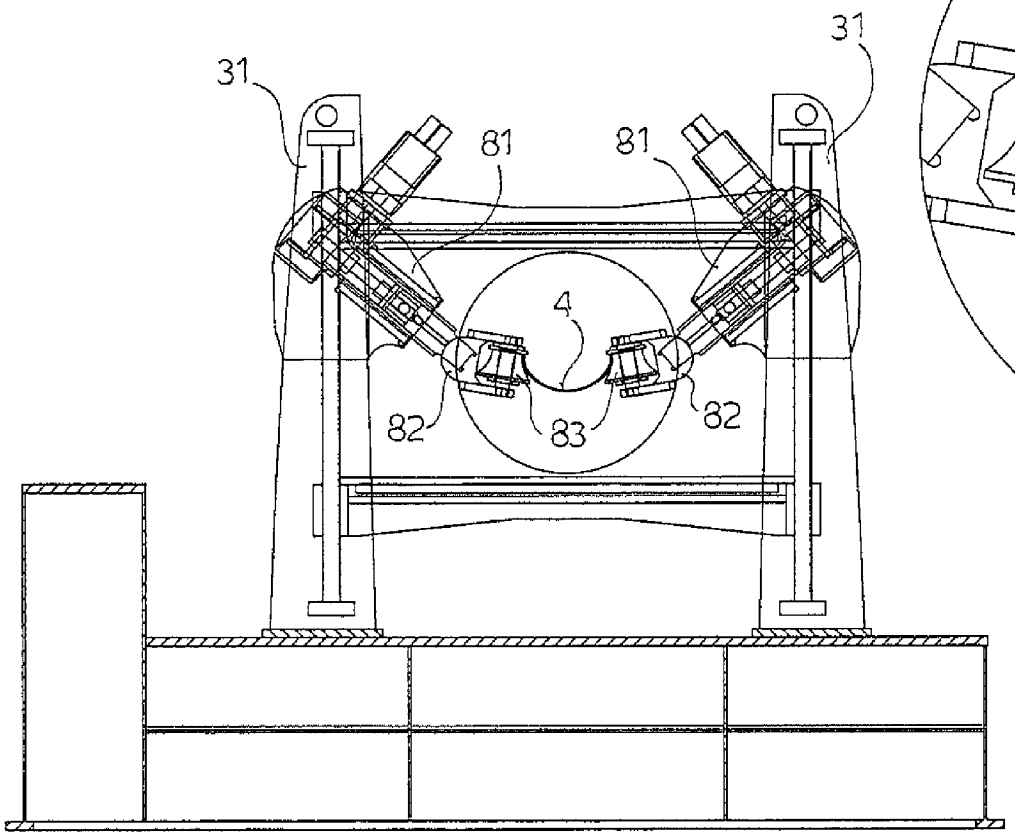

FIG. 8 shows diagrammatically a front view of one of the containment stations 12 situated downstream of the forming stations 3 and 3'.

This station 12, symmetrical with respect to the midline, consists of two guides 81, fixed to uprights 31, each of which allows translation along an inclined axis of a shoe 82 which supports an idle roller 83, having a concave profile, which guides and supports the strip of sheet metal 4 between two adjacent forming stations (3, 3').

The containment stations 12 can be omitted without departing from the scope of the invention.

The upper part of each rollers 83 presents a protruding disc element 84 (seen better in FIG. 8*a*, which shows diagrammatically an enlarged detail of the containment station 12), which protrudes with respect to the body of the roller 83 to contain the edge 6 of the strip of sheet metal 4.

Figure 9A:
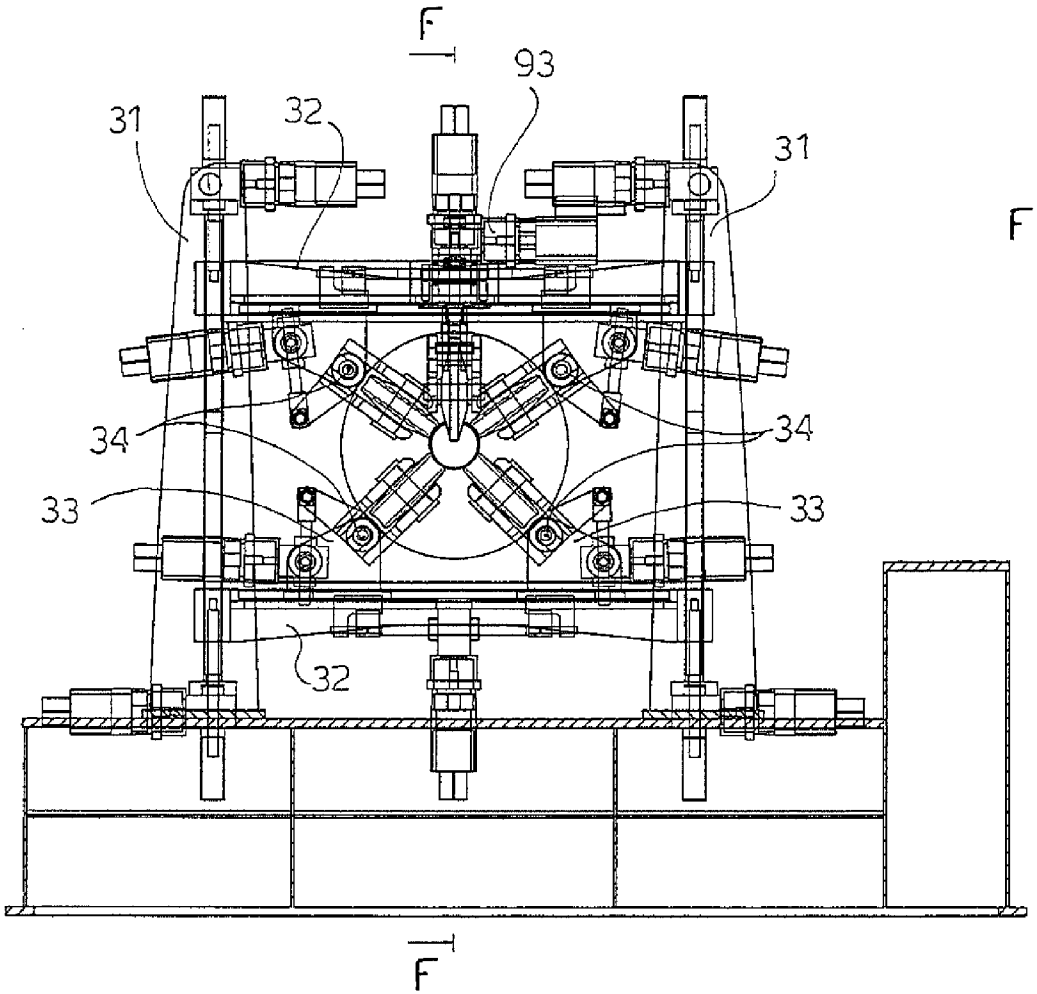
FIG. 9 shows diagrammatically a front view (FIG. 9*a*), a side view (FIG. 9*b*) sectioned along the plane F-F of FIG. 9*a* and an enlarged detail (FIG. 9*c*) of a finishing station belonging to the machine of FIG. 1.
Figure 9C:
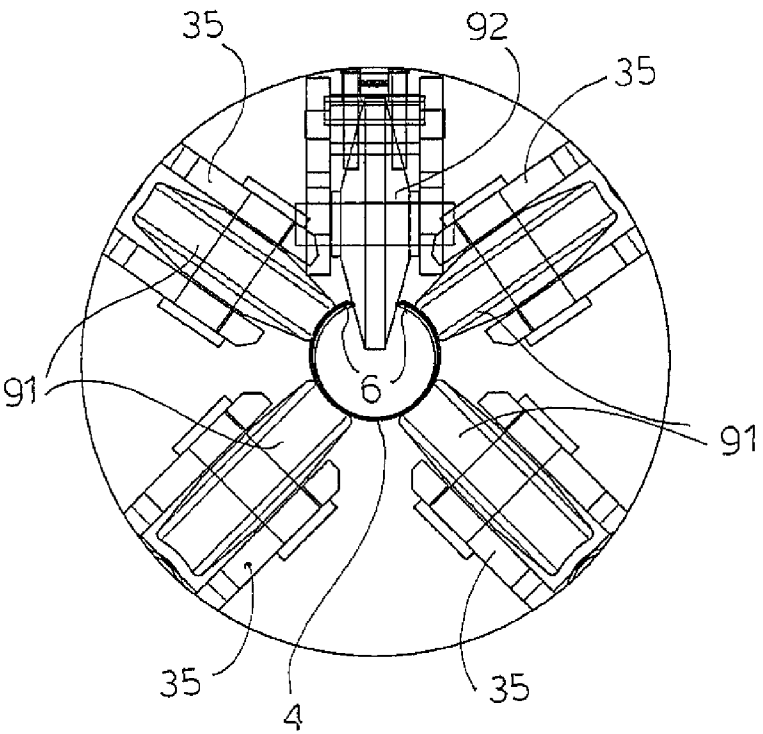
Figure 9B:
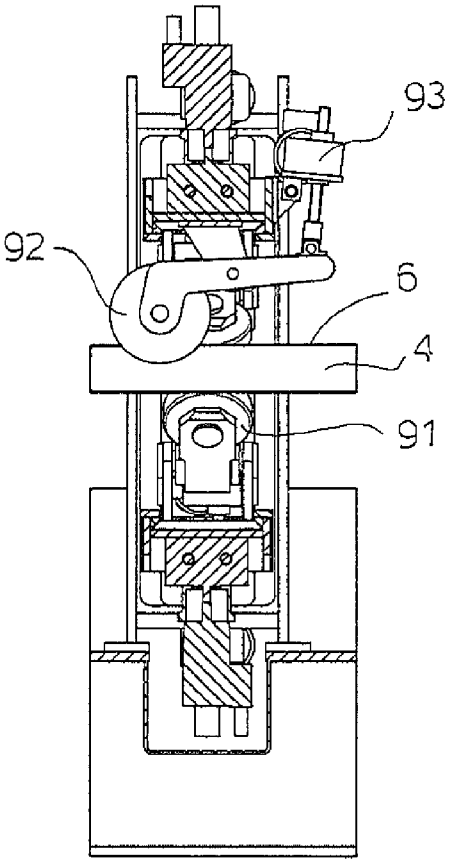

FIG. 9*a* shows diagrammatically a front view (FIG. 9*a*) and a side view sectioned along the plane F-F of FIG. 9*a* (FIG. 9*b*)

of a finishing station 5 belonging to the machine 1, which differs from the forming stations (3, 3') previously described essentially in that each of the units 35 carries a forming roller 91 acting on the outer surface of the strip of sheet metal 4 bent to form the tube 2 and in that it further comprises a roller 92, the position of which between the edges 6 of the strip of sheet metal 4 forming the tube 2 is adjustable by means of a lever 93 operated in a per se known manner.

The units 35 and the rollers 91 and 92, seen better in FIG. 9*c*, have not been designated with the corresponding reference numerals in FIG. 9*a* for the sake of clarity of the graphic representation.

The forming rollers 91 have a concave profile, with a constant curvature equal to the maximum value of the curvature presented by the strip of bent sheet metal 4 in correspondence to the finishing station 5 during production of one of the tubes 2 that can be produced without replacing the forming rollers (8, 8', 8") of the forming stations (3, 3'); the roller 92 has a convex V-shaped profile.

In FIG. 9*b* the strip of sheet metal 4, one of the forming rollers 91, the roller 92 inserted in the strip of sheet metal 4 and the lever 93 which adjusts the position of the roller 92 can be seen.

FIG. 9*c* shows diagrammatically an enlarged detail of the finishing station 5 of FIG. 9*a*, where the forming rollers 91 acting on the outer surface of the strip of sheet metal 4 bent to form the tube 2 and the roller 92 situated between the edges 6 of the strip of sheet metal 4 can be seen better.

Without departing form the scope of the invention, a person skilled in the art can make to the above described machine with variable linear structure all the modifications and improvements suggested by normal experience and/or by the natural evolution of the art.

The invention claimed is:

1. A machine for the continuous formation of tubes, the machine comprising:

at least one first forming station and at least one second forming station able to progressively bend a strip of sheet metal, the at least one second forming station being subsequent to the at least one first forming station, each forming station including two pairs of idle forming rollers configured to carry out rototranslational movements of a same extent and in opposite directions, each of lower rollers of the idle forming rollers having an elliptical profile having a decreasing curvature from an outside edge to an inside edge of each lower roller, each of upper rollers of the idle forming rollers of the first forming station having an elliptical profile having increasing curvature from an outside edge to an inside edge of each upper roller, each of upper rollers of the idle forming rollers of the at least one second forming station having a circular profile; and at least one finishing station configured to bring together edges of the bent strip of sheet metal, the forming stations and the at least one finishing station being disposed in sequence with respect to each other in a linear configuration.

2. The machine according to claim 1, wherein the radius of the circular profile of the upper rollers of each second forming station corresponds to the minimum radius of curvature of the bent strip of sheet metal corresponding to each said second forming station.

3. The machine according to claim 1, wherein the pairs of forming rollers belonging to the at least one first forming station being configured to deform outermost areas of the strip of sheet metal, and the pairs of forming rollers, belonging to the at least one second forming station being configured to deform an inner part of the strip of sheet metal.

4. The machine according to claim 1, further comprising a plurality of containment stations, one of the containment stations being situated after each one of the forming stations.

5. The machine according to claim 1, wherein the elliptical profiles of the upper rollers are not matching profiles with respect to the elliptical profiles of the lower rollers.

6. A machine for the continuous formation of tubes, the machine comprising:

at least one first forming station and at least one second forming station able to progressively bend a strip of sheet metal, the at least one second forming station being subsequent to the at least one first forming station, each forming station including two pairs of idle forming rollers configured to carry out rototranslational movements of a same extent and in opposite directions, each of lower rollers of the idle forming rollers having an elliptical profile having a decreasing curvature from an outside edge to an inside edge of each lower roller, each of upper rollers of the idle forming rollers of the at least one first forming station having an elliptical profile having increasing curvature from an outside edge to an inside edge of each upper roller, each of upper rollers of the idle forming rollers of the at least one second forming station having a circular profile; and at least one finishing station configured to bring together edges of the bent strip of sheet metal, the forming stations and the at least one finishing station being disposed in sequence with respect to each other in a linear configuration, wherein the at least one finishing station comprises four idle forming rollers having a concave profile with a constant curvature and able to carry out movements of the same extent and direction according to 90° axes.

7. A machine for the continuous formation of tubes, the machine comprising:

at least one first forming station and at least one second forming station able to progressively bend a strip of sheet metal, the at least one second forming station being subsequent to the at least one first forming station, each forming station including two pairs of idle forming rollers configured to carry out rototranslational movements of a same extent and in opposite directions, each of lower rollers of the idle forming rollers having an elliptical profile having a decreasing curvature from an outside edge to an inside edge of each lower roller, each of upper rollers of the idle forming rollers of the at least one first forming station having an elliptical profile having increasing curvature from an outside edge to an inside edge of each upper roller, each of upper rollers of the idle forming rollers of the at least one second forming station having a circular profile; and at least one finishing station configured to bring together edges of the bent strip of sheet metal, the forming stations and the at least one finishing station being disposed in sequence with respect to each other in a linear configuration, wherein each of the forming stations and the at least one finishing station include two vertical uprights that support two horizontal traverses configured to slide along the uprights, along each of said traverses sliding two shoes, on each of which is present a pivot that acts as a fulcrum for rotation of a unit that carries one of the forming rollers.

8. The machine according to claim 7, each of the units of the at least one finishing station carries a first, forming roller acting on an outer surface of the strip of sheet metal bent to form a tube and a second roller and a lever configured to adjust the position of the second roller of the at least one finishing station between the edges of the strip of sheet metal forming the tube.

9. The machine according to claim 8, wherein the first forming roller of each of the units has a concave profile, with a curvature constant and equal to the maximum value of the curvature presented by the bent strip of sheet metal corresponding to the at least one finishing station during the production of the tube, which is producible without replacing the upper and lower forming rollers of the forming stations, and the second roller of each of the units has a convex V-shaped profile.

10. A machine for the continuous formation of tubes, the machine comprising:

at least one first forming station and at least one second forming station able to progressively bend a strip of sheet metal, the at least one second forming station being subsequent to the at least one first forming station, each forming station including two pairs of idle forming rollers configured to carry out rototranslational movements of a same extent and in opposite directions, each of lower rollers of the idle forming rollers having an elliptical profile having a decreasing curvature from an outside edge to an inside edge of each lower roller, each of upper rollers of the idle forming rollers of the at least one first forming station having an elliptical profile having increasing curvature from an outside edge to an inside edge of each upper roller, each of upper rollers of the idle forming rollers of the at least one second forming station having a circular profile;

at least one finishing station configured to bring together edges of the bent strip of sheet metal, the forming stations and the at least one finishing station being disposed in sequence with respect to each other in a linear configuration; and a plurality of containment stations, one of the containment stations being situated after each one of the forming stations, wherein each containment station includes two guides fixed to vertical uprights of one or more of the forming stations, each of which allows the translation according to an inclined axis of a shoe that carries a roller having a concave profile that is able to guide and to support the strip of sheet metal between two adjacent forming stations.

11. The machine according to claim 10, wherein each roller includes a disc element that protrudes from an upper part of a body of the roller, the disc element being configured to contain one or more of the edges of the strip of sheet metal.

* * * * *